US006240756B1

(12) United States Patent
Tsugeno

(10) Patent No.: US 6,240,756 B1
(45) Date of Patent: Jun. 5, 2001

(54) PATH SCHEDULING METHOD AND SYSTEM FOR ROLLING MILLS

(75) Inventor: Masashi Tsugeno, Mitaka (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/455,377

(22) Filed: Dec. 6, 1999

(30) Foreign Application Priority Data

Dec. 4, 1998 (JP) ..... 10-345963

(51) Int. Cl.[7] ..... B21B 37/16

(52) U.S. Cl. ..... 72/8.1; 72/10.3; 72/10.4; 72/11.8; 72/365.2

(58) Field of Search ..... 72/8.1, 8.3, 9.2, 72/9.5, 10.3, 11.1, 11.2, 11.8, 12.1, 9.1, 10.1, 10.4, 10.7, 11.7, 365.2

(56) References Cited

U.S. PATENT DOCUMENTS

| | | | | |
|---|---|---|---|---|
| 4,485,497 | | 12/1984 | Miura . | |
| 4,633,692 | | 1/1987 | Watanabe . | |
| 4,736,305 | | 4/1988 | Watanabe . | |
| 5,241,847 | | 9/1993 | Tsugeno et al. . | |
| 5,461,894 | * | 10/1995 | Sorgel | 72/8.1 |
| 5,609,053 | * | 3/1997 | Ferreira et al. | 72/9.2 |
| 5,809,817 | * | 9/1998 | Ginzburg | 72/10.3 |
| 5,966,682 | * | 10/1999 | Gramckow et al. | 72/9.2 |

FOREIGN PATENT DOCUMENTS

| | | | | |
|---|---|---|---|---|
| 6-269827 | * | 9/1994 | (JP) | 72/9.2 |

* cited by examiner

*Primary Examiner*—Ed Tolan
(74) *Attorney, Agent, or Firm*—Oblon, Spivak, McClelland, Maier & Neustadt, P.C.

(57) ABSTRACT

A tandem rolling mill (FM) has mill stands (Fi; i=1 to 7) to be controlled in conformity with given rolling conditions (j) to execute a given path schedule for a coil (1) to be rolled by rolls (WR) of the mill stands (Fi) to scheduled thicknesses ($h_i$) at exit sides of the mill stands (Fi), with scheduled peripheral speeds ($V_i$) of the rolls (WR). The mill stands (Fi) are checked for non-conformity with any rolling condition (j), correction amounts ($\Delta\gamma_i$) are calculated of normalized values ($\gamma_{i*}$) of rolling forces ($P_{i*}$) of non-conforming mill stands (Fi*), as necessary to meet any rolling condition (j*), the normalized values ($\gamma_{i*}$) are corrected by a maximal one of the correction amounts ($\Delta\gamma_i$) to provide corrected values as targets ($\gamma_{ti*}$) to be achieved at the non-conforming stands (Fi*), and the given path schedule is re-scheduled to achieve the targets ($\gamma_{ti*}$) by determining re-scheduled thicknesses ($h_i$) of the coil (1) and re-scheduled peripheral speeds ($V_i$) of the rolls (WR), both independently defining a mass flow of the coil (1) to be constant at the respective mill stands (Fi).

13 Claims, 8 Drawing Sheets

PATH SCHEDULING METHOD AND SYSTEM FOR ROLLING MILLS

BACKGROUND OF THE INVENTION

1. Field of the Invention

The present invention relates to a path scheduling method and system. More specifically, the invention relates to a path re-scheduling method for rolling mills and a path re-scheduling system for rolling mills, and in particular, to an optimum path schedule determining method for a rolling mill that rolls a coil to be coiled and the like (hereafter collectively referred to "coil"), as well as to an optimum path schedule determining system for such a rolling mill.

2. Description of the Related Art

In a rolling mill having N ($N \leqq 2$) stands for rolling a coil, the determination of a schedule covering an optimum exit thickness of the coil at each stand is important from the standpoint of achieving stable mill operation and maintaining high quality of a finished product.

In a conventional approach to determine an optimum path schedule, a basic path schedule is determined, covering e.g. rolling reductions at respective stands to be distributed as specified in value, and employed for calculation of values of associated parameters at each stand, such as rolling force, bite angle, linear force, neutral point position, torque, power, and rolling speed, and when a calculated value exceeds a specified mechanical limit or conditional limit for stable operation, an optimization is made by changing distribution of rolling forces such as to the offending stand, thereby preparing an optimized path schedule.

With recent advances in production technology and diversifying demands for product quality, however, the actual operation of rolling mills has become extremely complex. For stable mill operation to be still maintained, necessary factors to be considered have increased in number for determination of a path schedule to be optimized yet better, with increased importance to a precise prediction by calculation.

Conventionally employed limits are as follows:

(1) Rolling force. To provide mechanical protection for mill elements such as load cells, a limit is imposed on the withstanding force. Typically, in order to prevent fatigue failures after long periods of operation, a safety factor is multiplied to an actual specified value to be smaller.

(2) Rolling torque. A limit on rolling torque is established so as to protect the drive system elements such as the mill spindle.

(3) Motor power. This limit is established to provide electrical protection for the main motor of the mill.

(4) Bite angle. With hot rolling in particular using a hot strip mill, the bite angle at the end of a coil is a particularly important factor in achieving stable operation. If the rolling reduction of a stand is excessive, so that the bite angle limit is exceeded, the bite at the next stand is adversely affected, thereby risking accidents. This limit is provided to prevent such occurrences.

(5) Unit force per width. In a tandem cold mill that cold rolls a coil, if the unit force per width exceeds a certain value, the condition for lubrication between the coil surface and the roll surface worsens, leading sometimes to surface damages known as heat scratches. Setting this limit is done to prevent such damages.

(6) Neutral point. This limit is also set in a tandem cold mill. If conditions are set so that the neutral point is deviated near the exit or entrance side of the roll bite, or so that it slips out of the roll bite, slipping can occur within the roll bite, this being a direct cause of vibration of the mill. If this slipping is excessive, it can even lead to breakage of the coil, and this limit is set to prevent such problems.

(7) Rolling speed. In order to protect the main motor, it is necessary to check the speed control at each stand of the mill.

It will be understood that checking criteria other than those noted above are generally set, in accordance with running conditions, and that the more limit items there are, the better must be the optimum path schedule.

A conventional method is disclosed, in Japanese Patent Application Laid-Open Publication No. 1-233003, whereby if the predicted power of the motor at a particular stand exceeded a limit value, based on the difference between the predicted motor power and the limit value, an influence factor, which is the calculated amount of power change at other stands for a motor power change that causes a minute variation in entrance and exit thickenesses of coil at each stand, and a standard power distribution ratio are used to distribute the power of the limit-exceeding stand among other stands, so as to correct the exit thicknesses at each stand in the basic path schedule, thereby maintaining the power balance between the stands.

In another method disclosed in Japanese Patent Application Laid-Open Publication No. 5-269514, a number of rolling conditions required for normal operation at each stand are checked and, with regard to a stand at which any limit value is exceeded, based on influence factors of entrance and exit thicknesses of coil for that condition, the basic schedule for that stand is changed so that the limit value is not exceeded.

SUMMARY OF THE INVENTION

In the above-noted methods, a plurality of rolling conditions that must be satisfied in order to achieve normal operation of each stand of a rolling mill are checked and, if any limit value is exceeded, the optimum path schedule is adjusted so as to correct the exit thickness of the offending stand. In a multistand rolling mill, because adjustment of speed is important, when the exit thickness is corrected, it is necessary to simultaneously adjust the speed of other stands, in order to satisfy the principle of constant mass flow. In the methods of the past, however, an influence factor is used to determine only the amount of exit thickness correction, the calculation method being used not taking into account the amount of speed correction. That is, when the exit thickness at each stand is changed during actual operation, in order to keep constant mass flow, it is necessary to simultaneously determine the speed (or more precisely the work roll peripheral speed) at each stand. This is because, with a change in the exit thickness, there is a change in speed to maintain constant mass flow, causing a change in speed of deformation of the material, and an accompanying change in deformation resistance at each stand, resulting in a change in quantities such as rolling force, rolling torque, and motor power, which are related to force. Because the amount of exit thickness correction determined without considering the change in speed that accompanies the change in exit thickness either does not strictly satisfy the requirement for constant mass flow, or does not take into consideration the change in force characteristics that are dependent upon speed, such as change in deformation resistance that accompanies a change in speed, there exists a problem with calculating an incorrect balance of rolling forces, by using the speed before the correction.

Using the methods of the past, it is possible to determine a path schedule so that limit values are not exceeded, by correcting the exit thickness from a stand for which a limit value is exceeded, and to maintain a balance of various quantities at all the other stands by means of basic path schedule, because the amount of speed correction required to maintain constant mass flow is not calculated when the exit thickness correction is determined, the results of the corrected path schedule does not necessarily followed the prescribed force, thereby hindering the achievement of the desired balance between various parameters. Additionally, using a path schedule that is corrected for exit thickness without consideration given to the speed required to satisfy the condition of constant mass flow, if the amount of exit thickness correction is particularly large, the passage of the coil itself can become unstable, leading to a worsening of flatness and crown quality problems. In extreme cases, serious accidents such as breakage of the coil can even occur.

The present invention has been made with such points in view. It therefore is an object of the present invention to provide a method for determining an optimum path schedule for a rolling mill, which, while maintaining strict adherence to constant mass flow at each stand of the mill, determines an optimum path schedule with regard to a stand at which a plurality of limit values are exceeded, so as to maintain the force distributing proportion of a basic path schedule for the other stands, so that these limit values are not exceeded, with a resultant achievement of stable rolling of coils of high quality. It is a further object of the present invention to provide a system with which the above-noted method is implemented.

To achieve the object, an aspect of the present invention is a path scheduling method for a tandem rolling mill having a plurality of mill stands to be controlled in conformity with a plurality of given rolling conditions to execute a given path schedule for a coil to be rolled by rolls of the plurality of mill stands to scheduled thicknesses at exit sides of the plurality of mill stands, with scheduled peripheral speeds of the rolls, the path scheduling method comprising the steps of checking the plurality of mill stands for non-conformity with any of the plurality of given rolling conditions, calculating correction amounts of normalized values of rolling forces of non-conforming mill stands, as necessary to meet any of the plurality of given rolling conditions, correcting the normalized values by a maximal one of the correction amounts to provide corrected values as targets to be achieved at the non-conforming mill stands, and re-scheduling the given path schedule to achieve the targets by determining a plurality of re-scheduled exit thicknesses of the coil and a plurality of re-scheduled peripheral speeds of the rolls, both independently defining a mass flow of the coil to be constant at the plurality of mill stands.

According to this aspect, a tandem rolling mill having a plurality of mill stands can be effectively controlled in conformity with a plurality of given rolling conditions to execute a re-scheduled path schedule for a coil to be rolled by rolls of the mill stands, to re-scheduled thicknesses at their exit sides and with re-scheduled peripheral speeds of their rolls, while maintaining strict adherence to the principle of constant mass flow, as both the re-scheduled exit thicknesses and the re-scheduled roll peripheral speeds "independently" define a mass flow of the coil to be constant at the respective mill stands.

The re-scheduled exit thicknesses and the re-scheduled roll peripheral speeds may preferably be determined by computationally solving, e.g. by a stepwise numerical approximation, a plurality of simultaneous equations, such as partial differential equations, each respectively including variables representative of an exit thickness and a roll peripheral speed at a corresponding one of the plurality of mill stands, where the coil has a constant mass flow. In other words, as a flow rate of mass of a concerned length or portion of a coil to be rolled continuously (, i.e. at different time points) by a plurality of mill stands is defined at a respective mill stand by a set of "independent" variables including an "exit thickness" and a "roll peripheral speed" at the respective mill stand, respective mass flow rates defined (for the different time points) at the plurality of mill stands (that roll different locations or portions of the coil) may preferably be deemed to be "simultaneously" equal to each other to provide a set of simultaneous equations of the variables.

Another aspect of the invention is a path scheduling system for a tandem rolling mill having a plurality of mill stands to be controlled in conformity with a plurality of given rolling conditions to execute a given path schedule for a coil to be rolled by rolls of the plurality of mill stands to scheduled thicknesses at exit sides of the plurality of mill stands, with scheduled peripheral speeds of the rolls, the path scheduling system comprising a checker for checking the plurality of mill stands for non-conformity with any of the plurality of given rolling conditions, a calculator for calculating correction amounts of normalized values of rolling forces of non-conforming mill stands, as necessary to meet any of the plurality of given rolling conditions, and correcting the normalized values by a maximal one of the correction amounts to provide corrected values as targets to be achieved at the non-conforming mill stands, and a scheduler for re-scheduling the given path schedule to achieve the targets by determining a plurality of re-scheduled exit thicknesses of the coil and a plurality of re-scheduled peripheral speeds of the rolls, both independently defining a mass flow of the coil to be constant at the plurality of mill stands.

According to this aspect also, there can be achieved like effects to that aspect.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIGS. 2A and 2B illustrate how the optimum path schedule determining system corrects a given basic path schedule, in which FIG. 2A is a graph of distributed rolling forces among stands of the rolling mill, and FIG. 2B is a graph of distributed rolling reductions among the stands;

DETAILED DESCRIPTION OF THE PREFERRED EMBODIMENTS

Figure 1:
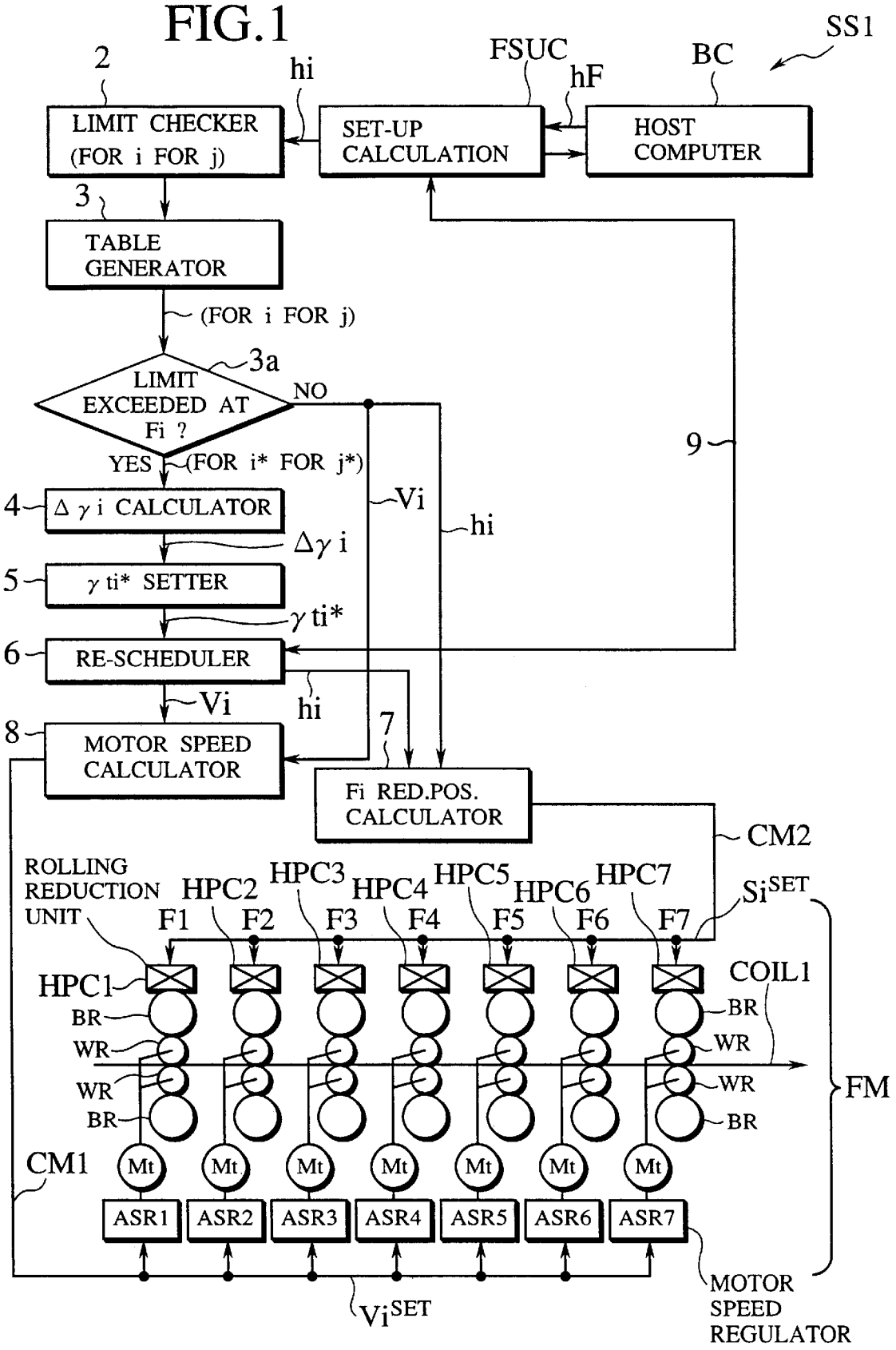
FIG. 1 is a block diagram showing an optimum path schedule determining system for a rolling mill according to an embodiment of the invention.

There will be detailed below the preferred embodiments of the present invention with reference to the accompanying drawings. Like members are designated by like reference characters.

Figure 2A:
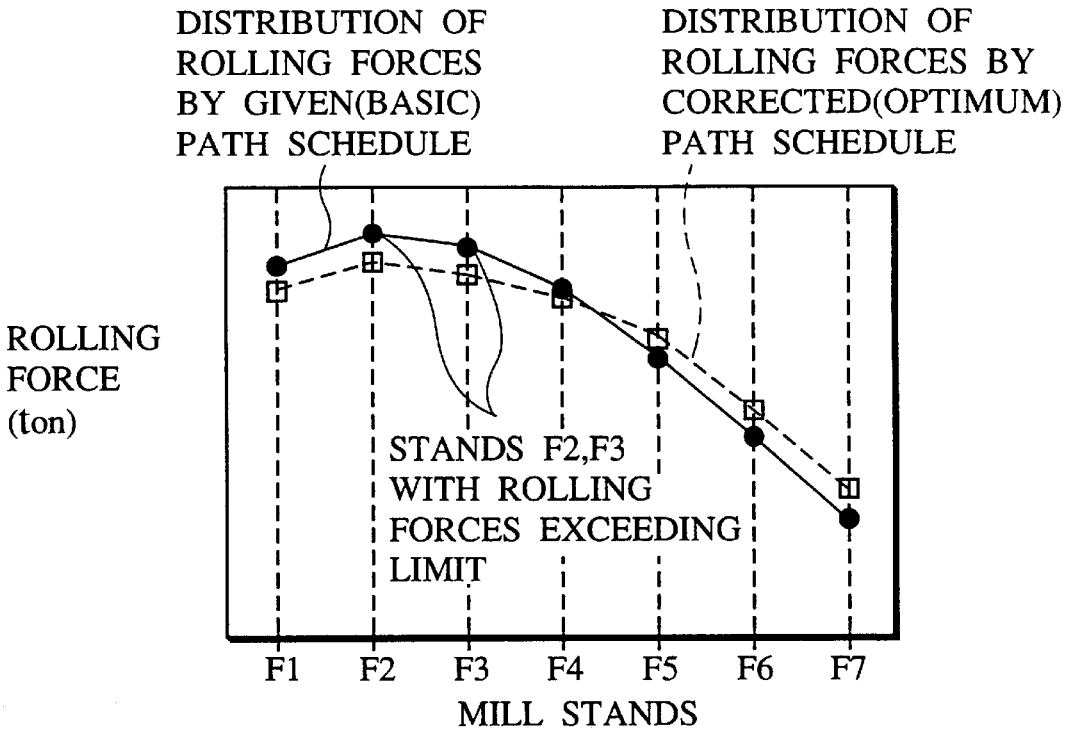
Figure 2B:
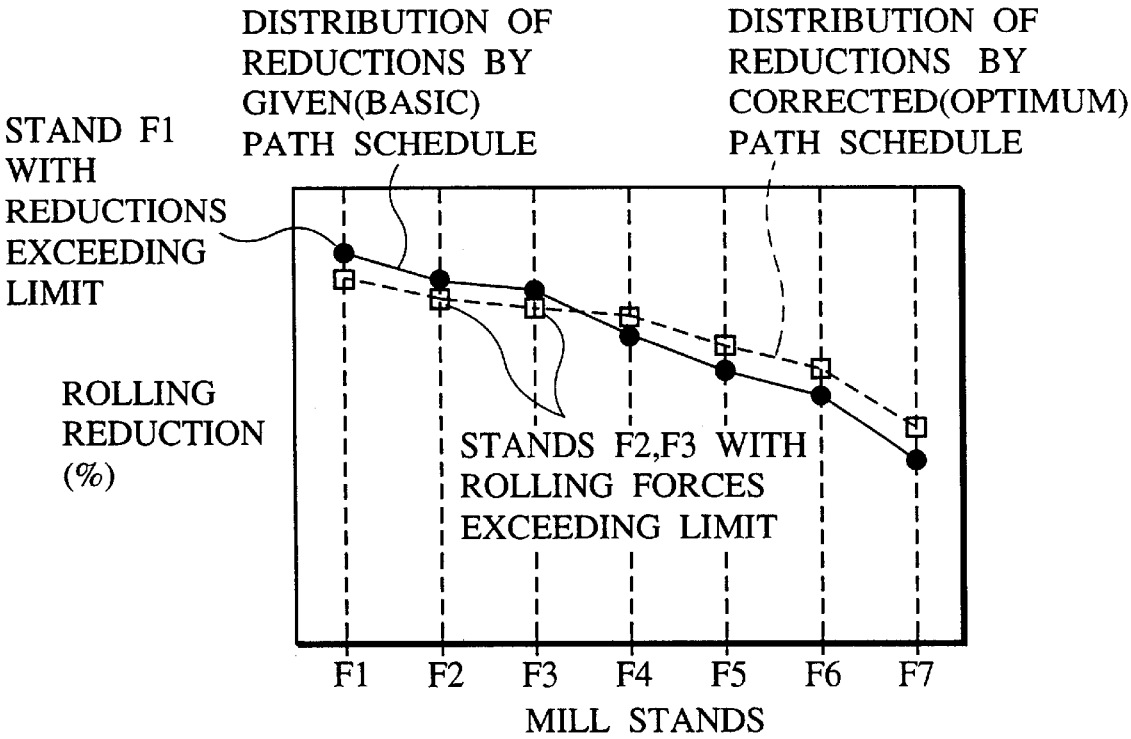
Figure 3:
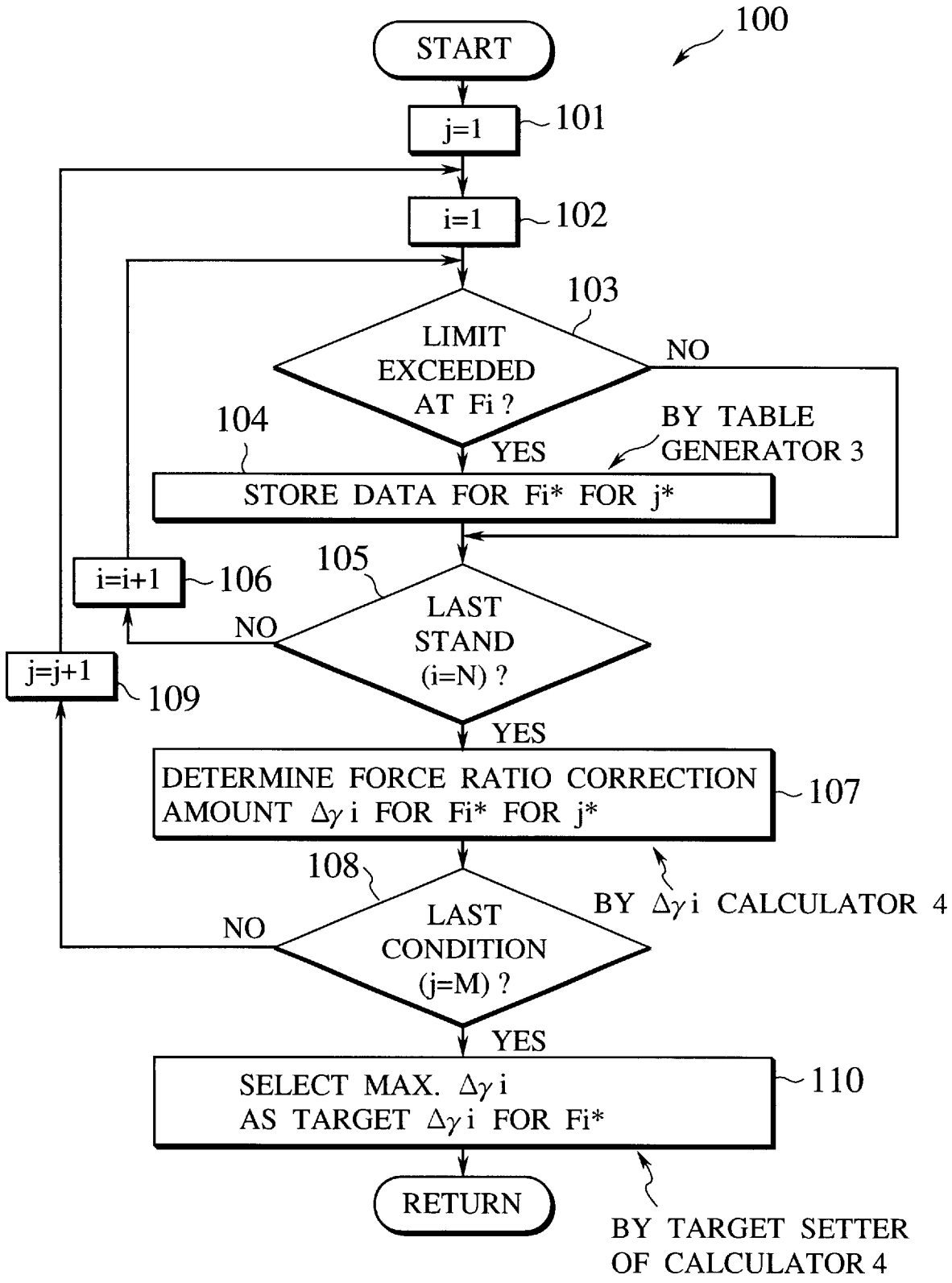
FIG. 3 is a flowchart of control associated with a target setting routine in a re-scheduling process of the system of FIG. 1.
Figure 6A:
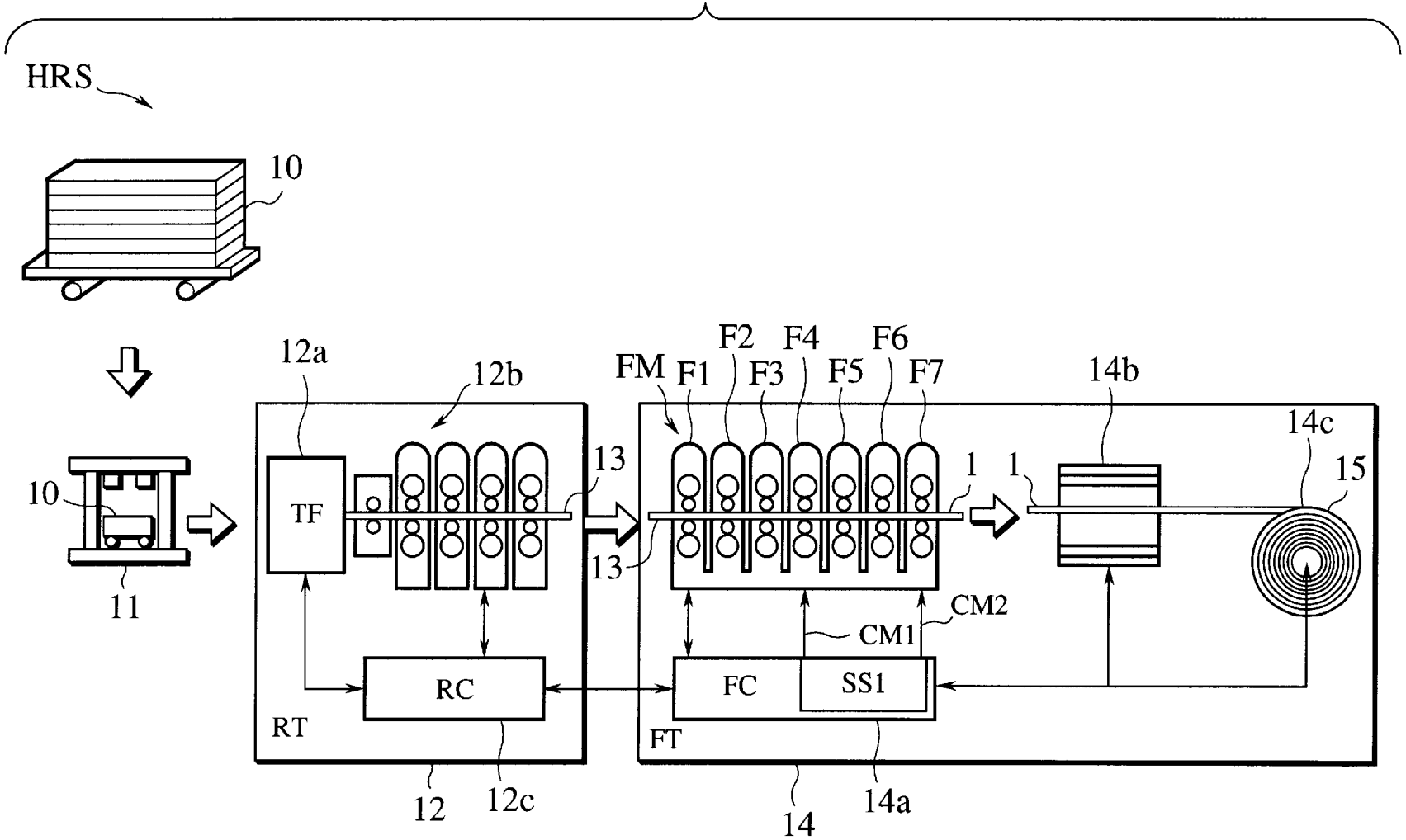
FIGS. 6A, 6B, 7A and 7B are supplemental figures illustrating basic arrangements common to the embodiments.
Figure 6B:
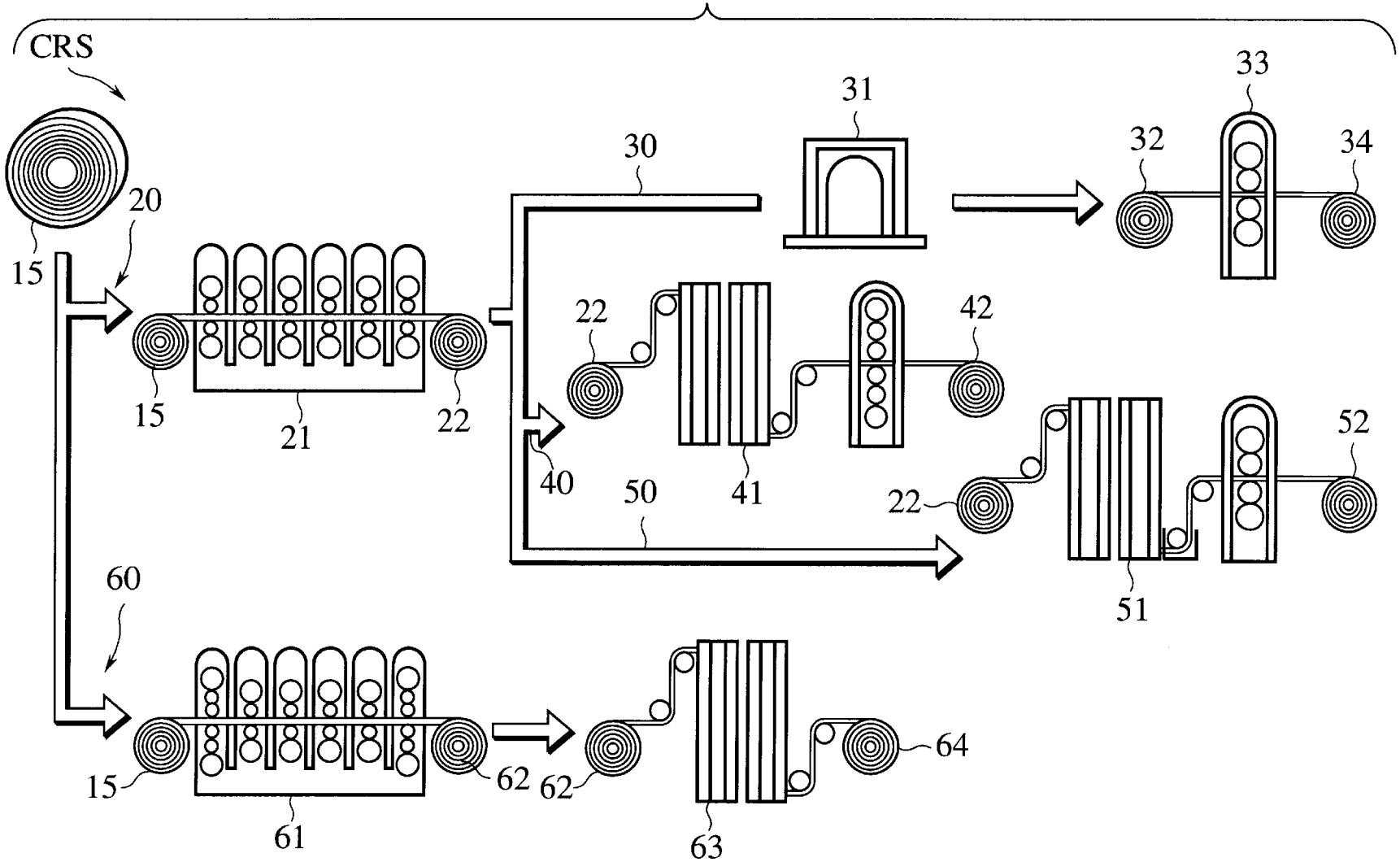
Figure 7A:
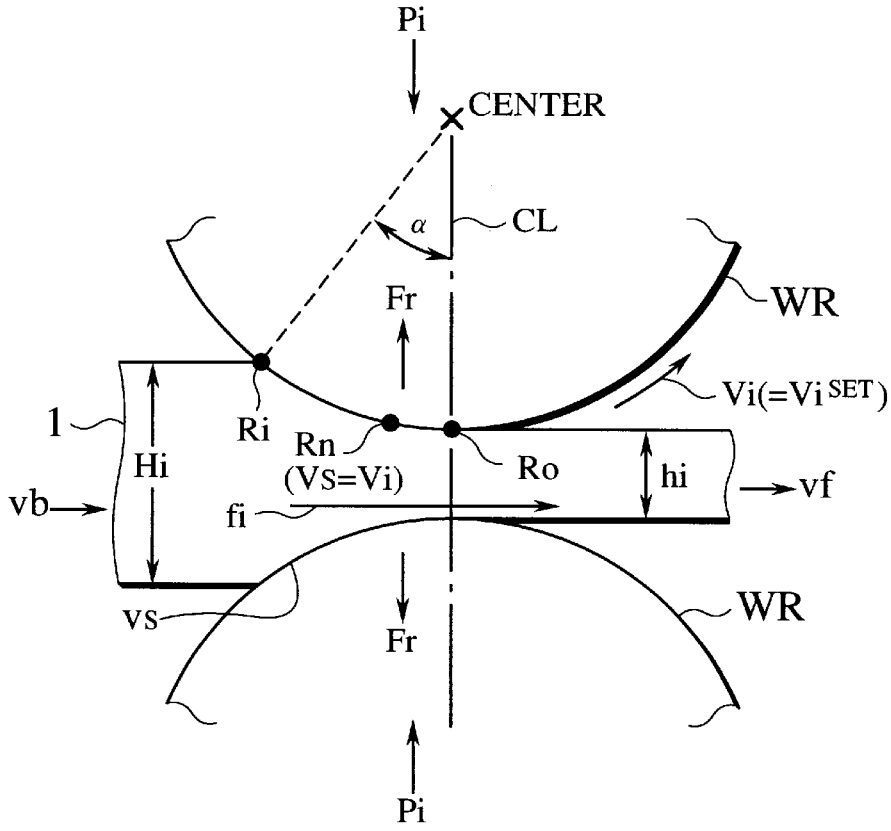
Figure 7B:
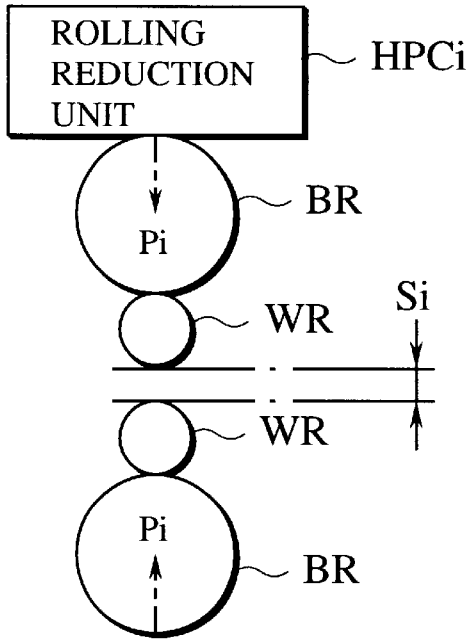

FIG. 1 through FIG. 3 show an optimum path schedule determining system SS1 as a path scheduling system for a finishing 7-stand tandem rolling mill FM (hereinafter sometimes simply called "rolling mill" or "mill") according to a first embodiment of the present invention, FIG. 6A shows a hot rolling system HRS in which the rolling mill FM and the optimum path schedule determining system SS1 are employed, FIG. 6B illustrates a cold rolling system CRS to which the optimum path schedule determining system SS1 is applicable, and FIGS. 7A and 7B illustrate relationships among associated parameters.

The hot rolling system HRS of FIG. 6A continuously processes hot slabs 10 from a steel molding system, and includes: a soaking pit 11 for reheating the slabs 10; a rougher or roughing train (RT) 12 which has a tunnel furnace (TF) 12*a,* a rough rolling mill 12*b* and a roughing train controller (RC) 12*c* interfaced with the furnace 12*a* and the mill 12*b* and which is adapted for processing the reheated slabs 10 to provide a roughly rolled transfer bar 13; and a finisher or finishing train (FT) 14 which has the rolling mill FM and a finishing train controller (FC) 14*a* interfaced with the mill FM and the roughing train controller 12*c* and which is adapted for processing the bar 13 to provide a coil 1 to be coiled as a hot coil 15, by a combination of a runout table 14*b* and a down-coiler 14*c* or up-coiler, which are goverened by the finishing train controller 14*a*.

The optimum path schedule determining system SS1 is incorporated in the roughing train contoller 14*a,* and has command lines CM1, CM2 thereof connected to the mill FM.

The cold rolling system CRS of FIG. 6B is for rolling a hot coil 15, and has a first production line 20 for producing a line-up of cold rolled articles such as a cold steel coil or sheet and a zinc coated steel coil or sheet, and a second production line 60 for producing another line-up of cold rolled products such as a tin or chrome coated steel coil or sheet.

The first production line 20 includes a 5-stand tandem cold rolling mill 21 for rolling the hot coil 15 to provide a cold rolled coil 22 to be processed in: a first sub-line 30 where it is stacked in an annealing furnace 31 and an annealed coil 32 is re-rolled for quality control at a subsequent rolling stand 33 to provide a coil product 34; a second sub-line 40 where it is processed by a continuous annealing processor 41 and rolled to provide a coiled intermediate product 42; and a third sub-line 50 where it is zinc coated through a molten zinc bath 51 and rolled to provide a coated coil product 52.

The second production line 60 includes a 6-stand tandem cold rolling mill 61 for rolling the hot coil 15 to provide a cold rolled coil 62, which is continuously annealed at a subsequent station 63 to provide an annealed coil 64 to be re-rolled for quality control before a coating. The cold rolling mills 21 and 61 may have path schedules determined therefor by the optimum path schedule determining system SS1.

Referring to FIGS. 1 and 6A, the rolling mill has a total of N mill stands Fi (i=1 to N; N=7 in this case) that perform continuous rolling of the coil 1. Each stand Fi is provided with a rolling reduction unit HPCi (i=1 to 7) that sets a preset gap or opening between opposing work rolls WR supported by two or more backup rolls BR thereof (hereinafter only the work rolls WR are interested in and simply referred to "rolls"), a drive motor Mt for rotationally driving the rolls, and an automatic speed regulator ASRi (i=1 to 7) for controlling the motor Mt to thereby control rpm (revolutions per minute) of the rolls, so that the rolls have a peripheral speed $V_i$ (i=1 to 7) equivalent to a roll peripheral speed setting value $V_i^{SET}$(i=1 to 7) which is input to the speed regulator ASRi via the command line CM1, see FIG. 1.

As illustrated in FIG. 7A, when rolling a coil 1 at an arbitrary stand Fi, the coil 1 has an increasing surface speed vs, as it approaches from a run-in point Ri at a bite angle $\alpha$ to a run-out point Ro on a center-to-center line CL between the rolls, via a neutral point Rn where the surface speed vs coincides with the roll peripheral speed $V_i$. Accordingly, the coil 1 has at the exit side of the rolls an increased coil speed vf and a reduced exit thickness $h_i$ relative to an entering coil speed vb and an entering thickness $H_i$, and (vf−vb)/vb and $(H_i-h_i)/H_i$ are called a "forward slip" or "slip" and a "rolling reduction" or "reduction" at the stand Fi, respectively.

The exit thickness $h_i$ equals to a true roll gap during rolling, which depends on balance between rolling forces $P_i$ acting on a bit portion of the coil 1 (from the rolling reduction unit $HPC_i$, via rolls BR and WR, as illustrated by imaginary lines in FIG. 7B) and reaction forces Fr therefto. The true roll gap during rolling is varied from a preset gap $S_i$ between the rolls WR (see FIG. 7B), generally such that $h_i=S_i+(P_i/M_i)$, where $M_i$ is a mill constant.

The exit thickness of coil (or roll gap) and roll peripheral speed at a respective stand Fi are specified as $h_i$, $V_i$ in a current path schedule, and data thereon can be processed by a calculator 7 for calculating a rolling reduction position at the stand Fi and by a calculator 8 for calculating a motor speed of the stand Fi. A calculated motor speed is output via the command line CM1, as the set value $V_i^{SET}$ to a corresponding motor speed regulator ASRi, and a calculated reduction position is output via the command line CM2, as a set value ($S_i^{SET}$) to a corresponding rolling reduction unit HPCi.

The current path schedule is first prepared in a big program called "finisher set-up calculation" FSUC, and is given as a basic path schedule in the system SS1. It should be noted that practically the finisher set-up calculation FSUC includes a universal scheduler, which is commonly employed as a re-scheduler in the system SS1.

The given basic path schedule is sometimes re-scheduled in the system SS1, as will be detailed below. In such a case, a re-scheduled path schedule substitutes for the basic path schedule.

Normally, a host computer BC gives, to the finisher set-up calculation FSUC, a command that covers a product specification including a final thickness $h_F$ as a target to be achieved at the exit end of a last stand $F_N$ of the mill FM. In response to the command, the set-up calculation FSUC calculates roll gaps of all the N stands F1 to F7, as necessary for stable rolling and good product quality. Upon the calculation, the calculator FSUC refers to given and stored data including prescribed criteria, and determines a schedule based thereon, as a basic path schedule including an exit thickness $h_i$ at each stand Fi.

The finisher set-up calculation FSUC at this point gives primarily determined optimum values for parameters to be scheduled, such as exit thicknesses $h_i$ at the N stands, which parameters should however be varied in accordance with the working condition of equipment that changes with time. To ensure stable equipment operation within associated limitations, there are necessitated severe checks for errors.

In the system SS1, there are performed error checks to respective limits L(i,j) of a total of M rolling conditions-(j:j=1 to M) for a respective one Fi of the N stands. The M rolling conditions cover rolling force, rolling torque, motor power, bite angle, unit force per width, neutral point, rolling speed, and other necessary items, and their limits L(i,j) are defined as a maximum, extrenum or logic value formulated, as necessary. The definition of limits L(i,j) is executed at the set-up calculation FSUC, and resultant data are transmitted as part of the basic path schedule.

For example, with respect to the rolling force $P_i$ at a stand Fi, if 4000 tons be a specified maximum based on technical data of mechanical elements of the stand Fi, a portion thereof corresponding to a safety factor of e.g. 5% or near is subtracted therefrom to obtain an allowable maximum force as a limit L(i,j). If this limit L(i,j) is exceeded by a rolling force $P_i$ predicted for the stand Fi on basis of the basic path schedule, this schedule is required to be re-scheduled via a re-scheduling process of the system SS1, so that by e.g. setting an increased value to the exit thickness $h_i$ of the stand Fi, a rolling force $P_i$ predicted for the stand Fi on basis of a re-scheduled or corrected path schedule can have a reduced value under the limit L(i,j).

To achieve an optimal path schedule for the mill, the basic path schedule output from the finisher set-up calculation FSUC is subjected to whole condition checks at a limit checker 2, where for a respective one of the M rolling conditions-(j:j=1 to M), a corresponding operation, performance or status value is predicted or read as a sample data D(i,j) (e.g. data on $P_i$) for a respective one Fi of the N stands in accordance with the basic path schedule, and the stand Fi is checked if a representative value (e.g. $P_i$) of the sample data D(i,j) exceeds or over-ranges the limit L(i,j). Prediction or preparation of sample data D(i,j) may preferably be partially or wholly executed at the finisher set-up calculation FSUC or host computer BC, and resultant data may be transmitted as part of the basic path schedule.

Data on results of such NxM checks (hereinafter sometimes collectively referred to "limit check") are collected at a limit check table generator 3, which constitutes part of the limit checker 2, where they are arranged to prepare or processed to generate a limit check table as a listing of non-conformity for every stand Fi every condition-(j). The limit check table may be configured, for example, as shown below.

| Mill Stands | F1 | F2 | F3 | F4 | F5 | F6 | F7 |
|---|---|---|---|---|---|---|---|
| Condition-(1) | − | + | − | − | − | − | − |
| Condition-(2) | − | + | − | − | + | − | − |
| . . . | . . . | . . . | . . . | . . . | . . . | . . . | . . . |
| Condition-(j) | − | − | − | − | − | − | − |
| . . . | . . . | . . . | . . . | . . . | . . . | . . . | . . . |
| Condition-(M) | − | − | + | + | − | − | − |

In this table, "−" marks indicate sample data D(i,j) within limits L(i,j), and "+" marks indicate those exceeding associated limits.

The limit checker 2 is provided with a decision maker 3*a,* which reads data on the limit check table and makes a final decision on a respective rolling condition-(j) if a corresponding limit L(i,j) is exceeded at a respective stand Fi. If all the N stands Fi are conforming with respect to all the M conditions, the basic path schedule is deemed as a current path schedule, and its data on exit thicknesses $h_i$(i=1 to N) of the coil 1 and data on roll peripheral speeds $V_i$ (i=1 to N) are input to the reduction position calculator 7 and the motor speed calculator 8, respectively.

If any stand Fi is non-conforming with respect to any rolling condition-(j), the basic path schedule is re-scheduled through a below-described process to have a re-scheduled optimum path schedule as a current path schedule that will provide data on re-scheduled exit thicknesses $h_i$ (i=1 to N) of the coil 1 and data on re-scheduled roll peripheral speeds $V_i$ (i=1 to N) to be input to the calculator 7 and 8, respectively.

In the present case, limits L(i,j) of one (see FIG. 3) or more (see FIG. 4) rolling conditions-(j) are exceeded, individually at one (see FIG. 2B) or more (see FIG. 2A) mill stands Fi, and concurrently at two or more (see FIG. 2B) mill stands Fi. In regard of any such non-conforming stand Fi, the suffix "i" will sometimes be labeled with a *-mark, such that i*, for simplicity of description. Likewise, for an arbitrary rolling condition-(j), the identification number j will sometimes be labeled such that j*, when its limit is exceeded.

For a simultaneous control by the system SS1 covering N stands, the rolling forces $P_i$ of the N stands are normalized by dividing them by a maximal one $P_{max}$ of them, and resultant N rolling force ratios $\gamma_i$ are employed as parameters to be corrected, as necessary.

While the following expressions may be otherwise formulated depending on the type of rolling condition of which a limit is exceeded, a comprehensive example is now assumed such that a limit L(i,j) of rolling force is exceeded at a mill stand Fi*, and it is necessary to determine by calculation how much ($\Delta\gamma_i$) the rolling force ratio $\gamma_{i*}$ at the stand Fi* should be corrected for resolution of a limit-exceeding state of the rolling force $P_{i*}$. To do this, the system SS1 employs a force ratio correction amount calculator 4, which calculates necessary correction amounts ($\Delta\gamma_i$) of non-conforming force ratios ($\gamma_{i*}$) and, for this calculation, computes numerical partial differentials as parameters $C_n$ (=$C_{nn}$: $1 \leqq n \leqq N$) and $C_{mn}$ ($1 \leqq m \leqq N$, $m \neq n$) called "influence factors", such that:

$$C_n = C_{nn} = \partial P_n / \partial \gamma_n, \text{ and } C_{mn} = \partial P_m / \partial \gamma_n \quad (1).$$

By using such an influence factor ($C_n$; n=i), it is possible in the assumed example (i=i*) to determine from the amount of a required correction $\Delta P_i$ of the rolling force $P_{i*}$ the amount of a necessary correction $\Delta\gamma_i$ of the rolling force ratio $\gamma_{i*}$, such that:

$$\begin{aligned} \Delta P_i &= (\text{exceeding}) P_i * - (\text{conforming}) P_i \\ &\quad ( = (P^{\text{MAX}} - P_i) \text{ in an employed notation}), \text{ and} \\ &= C_i \cdot \Delta\gamma_i = (\partial P_i / \partial \gamma_i) \cdot \Delta\gamma_i \end{aligned} \quad (2)$$

$$\Delta\gamma_i = \Delta P_i / C_i = \Delta P_i / (\partial P_i / \partial \gamma_i). \quad (3)$$

For a certain condition-(j), if its limits L(i,j) are exceeded at a plurality of mill stands Fi*, care should be taken because of the interaction between the amounts of necessary corrections ($\Delta\gamma_i$) for force ratios ($\gamma_{i*}$) at respective stands Fi*. In such a case, the force ratio correction amount ($\Delta\gamma_i$) at each stand Fi* is determined as follows.

It is now assumed that force limits L(m,j) and L(n,j) are exceeded at an m-th stand Fm* (i.e. $i=m \leqq N$) and an n-th stand Fn* (i.e. $i=n \leqq N$), respectively.

The correction amounts of rolling force ratios $\gamma_{m*}$ and $\gamma_{n*}$ to be determined at the stands Fm* and Fn* are $\Delta\gamma_m$ and $\Delta\gamma_n$, respectively. When the rolling force ratio $\gamma_{m*}$ of the stand Fm* is changed, its influence is given also to the exit thickness $h_{n*}$ at the stand Fn*. It therefore is not meaningful to independently determine each of the rolling force ratio correction amounts $\Delta\gamma_m$ and $\Delta\gamma_n$.

Therefore, the amounts of required corrections $\Delta P_m$ and $\Delta P_n$ {i.e. $(P^{MAX}-P_m)$ and $(P^{MAX}-P_n)$ in employed notation} of rolling forces $P_{m*}$ and $P_{n*}$ at the stands Fm* and Fn* are formulated relative to the amounts of necessary corrections $\Delta\gamma_m$ and $\Delta\gamma_n$ of rolling force ratios $\gamma_{m*}$ and $\gamma_{n*}$, in a vector notation such that:

$$\begin{bmatrix}\Delta P_m\\ \Delta P_n\end{bmatrix}=\begin{bmatrix}(P^{\mathrm{MAX}}-P_m)\\ (P^{\mathrm{MAX}}-P_n)\end{bmatrix}=\begin{bmatrix}C_{mm} & C_{mn}\\ C_{nm} & C_{nn}\end{bmatrix}\begin{bmatrix}\Delta\gamma_m\\ \Delta\gamma_n\end{bmatrix}=\begin{bmatrix}\partial P_m/\partial\gamma_m & \partial P_m/\partial\gamma_n\\ \partial P_n/\partial\gamma_m & \partial P_n/\partial\gamma_n\end{bmatrix}\begin{bmatrix}\Delta\gamma_m\\ \Delta\gamma_n\end{bmatrix}. \tag{4}$$

By solving the simultaneous equations of formula (4), it is possible to determine the rolling force ratio correction amounts $\Delta\gamma_m$ and $\Delta\gamma_n$, such that:

$$\begin{bmatrix}\Delta\gamma_m\\ \Delta\gamma_n\end{bmatrix}=\begin{bmatrix}\partial P_m/\partial\gamma_m & \partial P_m/\partial\gamma_n\\ \partial P_n/\partial\gamma_m & \partial P_n/\partial\gamma_n\end{bmatrix}^{-1}\begin{bmatrix}\Delta P_m\\ \Delta P_n\end{bmatrix}, \tag{5}$$

where the notation $[]^{-1}$ indicates an inverse matrix, which is indefinite if the determinant of its original matrix in formula (4) is a zero, and the inverse matrix is determined after a decision of its definiteness, such that:

$$det\begin{bmatrix}\partial P_m/\partial\gamma_m & \partial P_m/\partial\gamma_n\\ \partial P_n/\partial\gamma_m & \partial P_n/\partial\gamma_n\end{bmatrix}=\begin{vmatrix}\partial P_m/\partial\gamma_m & \partial P_m/\partial\gamma_n\\ \partial P_n/\partial\gamma_m & \partial P_n/\partial\gamma_n\end{vmatrix}\neq 0. \tag{6}$$

While the above example is for the case in which arbitrary two stands Fm* and Fn* have exceeded limits L(m*,j*) and L(n*,j*) with respect to a common rolling condition-(j*), it will be understood that the method described can be easily extended to cover the case in which three or more stands experience exceeded limits with respect to a common rolling condition.

Such calculations are executed by a main program in the force ratio correction amount calculator 4, which outputs data on a calculated correction amount $\Delta\gamma_i$ of a respective rolling force ratio $\gamma_{i*}$ to be corrected, and the output data is processed at a force ratio setter 5, where the calculated correction amount $\Delta\gamma_i$ is added to the rolling force ratio $\gamma_{i*}$ to provide a corrected rolling force ratio $\gamma_{ti*}$, which is set up as a target to be achieved at a corresponding stand Fi* by re-scheduling the basic path schedule.

At any non-conforming stand Fi*, as such a correction is required for a respective one of a total of Q (where Q is an integer depending on i*, $0<Q\leqq M$) rolling conditions-(j*: j*=j1,j2, . . . , jQ) of which a limit is exceeded at the stand Fi*, there will be calculated Q rolling force ratio correction amounts $\{\Delta\gamma_i\}=\{\Delta\gamma_i(\text{for } j^*=j1), \Delta\gamma_i(\text{for } j^*=j2), \ldots, \Delta\gamma_i(\text{for } j^*=jQ)\}$ to meet criteria for the Q rolling conditions, with their values depending on the criteria. To cope with this situation at the force ratio setter 5, a maximal one $\Delta\gamma^{max}$ of the Q calculated amounts $\{\Delta\gamma_i\}$ is selected as a representative $\Delta\gamma_i$ for correction of a rolling force ratio $\gamma_{i*}$ of the stand Fi*, whereby a corrected rolling force ratio $\gamma_{ti*}$ is set up as a single target to be achieved at the stand Fi* with respect to the rolling force ratio $\gamma_i$.

The target rolling force ratio $\gamma_{ti*}$ is determined such that:

$$\gamma_{ti*}=\gamma_{i*}+(\text{representative})\Delta\gamma_i \tag{7}.$$

The rolling force ratio $\gamma_{i*}$ of expression (7) corresponds to a rolling force ratio used to determine the given basic path schedule. Data on the target rolling force ratio $\gamma_{ti*}$ is transmitted to a calculator 6 called "optimum schedule calculator" or "re-scheduler" 6, and therefrom (together with re-scheduled data) via an interface 9 to the finisher set-up calculation FSUC, where it will be based on to determine a subsequent basic path schedule. In this respect also, the re-scheduler 6 may preferably be constituted with a scheduler in the set-up calculation FSUC.

The re-scheduler 6 re-schedules the given basic path schedule for betterment to meet the target rolling force ratio $\gamma_{ti*}$ at each stand Fi*, by simultaneously determining a re-scheduled or corrected thickness $h_i$ and a re-scheduled or corrected roll peripheral speed $V_i$ for a respective stand Fi. Basic formulas for a path scheduling process are detailed in the Japanese Patent Publication No. 2635796 published Jul. 30, 1997, which is incorporated herein by reference. There will be described some basic formulas used in the re-scheduler 6.

The definition of the rolling force ratio $\gamma_i$ at an arbitrary i-th stand Fi is formulated by an expression, such that:

$$\gamma_i=P_i/P_{max}\ (\text{for } i=1 \text{ to } N) \tag{8},$$

where $P_i$ is the rolling force (in tons) of the stand Fi, and $P_{max}$ is a maximal one of rolling forces of all the N stands F1 to F7. A total of N rolling force ratios $\gamma_i$ reside within a range of $0<\gamma_i\leqq 1.0$, necessarily including a maximum $\gamma_i$ to be 1.0. Respective sides of an expression (8) for a respective stand Fi (i=2 to N) are divided by respective sides of an expression (8) for a previous stand Fi-1, such that:

$$\gamma_i/\gamma_{i-1}=P_i/P_{i-1}\ (\text{for } i=2 \text{ to } N) \text{ or } \gamma_i\cdot P_{i-1}=\gamma_{i-1}\cdot P_i\ (\text{for } i=2 \text{ to } N) \tag{9}.$$

The law of constant mass flow is formulated by an expression, such that:

$$(1+f_i)\cdot h_i\cdot V_i=U\ (\text{for } i=1 \text{ to } N) \tag{10},$$

where $f_i$ is the forward slip (dimension-less) of a coil at an arbitrary stand Fi, $h_i$ is the exit thickness (mm) of the coil 1 at the stand Fi, $V_i$ is the roll peripheral speed (mpm) at the stand Fi, and U is a volumetric speed (mpm.mm) of the coil 1 to be constant at respective exit sides of the stands F1 to F7.

In order to determine exit thicknesses $h_i$(i=1 to N) and roll peripheral speeds $V_i$(i=1 to N) that simultaneously satisfy a total of N−1 equations of formula (9) and a total of N equations of formula (10), a stepwise numerical computation based on the multidimensional Newton-Raphson method is applied, as follows.

Terms at both sides of the 2N−1 equations of the formulas (9) and (10) are rearranged at one side and collected as a set of serially numbered expressions, which is expressed in a matrix notation using a vector G consisting of 2N−1 elements $g_k$ (k=1 to 2N−1), such that:

$$g_k=(1+f_k)\cdot h_k\cdot V_k-U\quad(\text{for } k=1 \text{ to } N), \tag{11}$$

$$g_k=(\gamma_{(k-N+1)}\cdot P_{(k-N)})-(\gamma_{(k-N)}\cdot P_{(k-N+1)})\quad(\text{for } k=N+1 \text{ to } 2N-1),\ \text{and} \tag{12}$$

$$G=[g_1, g_2, \ldots, g_k, \ldots, g_{2N-1}]^T, \tag{13}$$

where $[]^T$ indicates a transposed matrix (i.e. a single-column matrix in this case).

The 2N−1 simultaneous equations are now componentwise expressed by a matrix equation, such that:

$$G=O,$$

where O is a single-column zero-value matrix as a zero vector. This equation involves a total of 2N−1 unknowns, and can be solved therefor. The 2N−1 unknowns are N−1 exit thicknesses $h_i$ (i=1 to N−1), N−1 roll peripheral speeds $V_i$ (i=1 to N−1), and the volumetric speed U of the coil 1. Note that at a pivot stand which usually is the last stand $F_N$, the exit-side thcikness $h_N$ is known as it is specified by the host computer BC, and the roll peripheral speed $V_N$ is determined to meet other requirements such as for a coil temperature to be as specified at the exit side of the stand $F_N$. The 2N−1 unknowns are componentwise expressed by a single-column unknwon vector X consisting of 2N−1 elements $x_r$ (r=1 to 2N−1), such that:

$$X = [x_1, x_2, \ldots, x_{N-1}, x_N, x_{N+1}, \ldots, x_{2N-2}, x_{2N-1}]^T \quad (14)$$
$$= [h_1, h_2, \ldots, h_{N-1}, V_1, V_2, \ldots, V_{N-1}, U]^T.$$

The Newton-Raphson method is a successive approximation in which, letting $x_r^{(s)}$ be an s-degree approximate solution for an unknown $x_r$, and $x_r^{(O)}$ be a given initial value, a sequence $\{X^{(s)}\}$ of approximate solution vectors $X^{(s)}=[x_1^{(s)}, x_2^{(s)}, \ldots, x_{2N-1}^{(s)}]^T$ (s=1 to a finite number) are successively determined until they converge within a given error range, each time by solving a matrix equation $$J\cdot(X^{(s)}-X^{(s-1)})+(G\bullet X^{(s-1)})=O \quad (15),$$

such that:

$$X^{(s)}=X^{(s-1)}-J^{-1}\cdot(G\bullet X^{(s-1)}),$$

where · indicates an outer product, (•) operates for componentwise substitution, $X^{(s-1)}$ is a previous solution vector that is known, and $J^{-1}$ is an inverse matrix of J, while J is a numerical Jacobian matrix, such that:

$$J = \begin{bmatrix} \partial g_1/\partial x_1 & \partial g_1/\partial x_2 & \cdots & \partial g_1/\partial x_{2N-1} \\ \partial g_2/\partial x_1 & \partial g_2/\partial x_2 & \cdots & \partial g_2/\partial x_{2N-1} \\ \vdots & \vdots & \ddots & \vdots \\ \partial g_{2N-1}/\partial x_1 & \partial g_{2N-1}/\partial x_2 & \cdots & \partial g_{2N-1}/\partial x_{2N-1} \end{bmatrix}, \quad (16)$$

in which the value of an element $\partial g_k/\partial x_r$ at an arbitrary k-th row at an arbitrary r-th column may be determined by a numerical partial differentiation, for example for each k=r≦−1, such that:

$$\frac{\partial g_k}{\partial x_r} = \frac{\partial f_k}{\partial h_r}\cdot h_k\cdot V_k + (1+f_k)\cdot V_k, \quad (17)$$

where the partial differentiation $\partial f_k/\partial h_r$ of the forward slip $f_k$ at a stand Fk with respect to the exit thickness $h_r$ at a stand Fr is calculated by predicting effects $f_k(h_r\pm\Delta h_r)$ thereon of an infinitesimal change $\Delta h_r$ of the exit thickness $h_r$, such that:

$$\frac{\partial f_k}{\partial h_r} = \frac{f_k(h_r+\Delta h_r) - f_k(h_r-\Delta h_r)}{2\cdot\Delta h_r}. \quad (18)$$

The convergence of the approximate solution sequence $\{X^{(s)}\}$ is decided by a defined distance between solution vectors $X^{(s-1)}$ and $X^{(s)}$ of last two degrees of approximation.

A well converged solution vector provides N−1 practical solutions for exit thicknesses $h_i$ (i=1 to N−1) and N−1 practical solutions for roll peripheral speeds $V_i$ (i=1 to N−1). Note that the thciknesses $h_i$ and the roll peripheral speeds $V_i$ have relationships to each other (like matrix elements $g_k$), but they are simultaneously solved as independent variables in the equation G=O. No roll peripheral speed $V_i$ is determined after solution of exit thickness $h_i$ of the coil 1, simply depending thereon.

The re-scheduler 6, given target rolling force ratios $\gamma_{ti*}$ of non-conforming stands Fi*, simultaneously determines such practical solutions for exit thicknesses $h_i$ and roll peripheral speeds $V_i$ of respective antecedent stands Fi (i=1 to N−1) before the pivot $F_N$, and employs those solutions and known parameters (e.g. $h_N$, $V_N$) to prepare a re-scheduled path schedule that provides re-scheduled (i.e. bettered or reserved) thicknesses $h_i$ and roll peripheral speeds $V_i$ for all the N stands F1 to F7.

Then, the reduction position calculator 7 receives the re-scheduled exit thicknesses $h_i$, and determines reduction position setting values $S_i^{SET}$ in consideration of various factors such as mill elongation due to force, which values ($S_i^{SET}$) are sent to the reduction units HPC1 to HPC7 of the N stands.

The motor speed calculator 8 receives the re-scheduled roll peripheral speeds $V_i$, and determines motor speed setting values $V_i^{SET}$ in consideration of a bit state of a moving coil 1, which values ($V_i^{SET}$) are sent to the automatic speed regulators ASR1 to ASR7 of the N stands.

There is achieved the advantage of eliminating predicted working states of the mill in which limits L(i*,j*) of rolling conditions-(j*) might have been exceeded at stands Ni*. There is determined an optimum path schedule that not only eliminates all limit-exceeding states, but also maintains strictly constant mass flow of the coil 1 through the mill, thereby providing an extremely stable path schedule, which enables stable operation and ensures high-quality product.

FIG. 2A exemplarily shows for comparison the distribution of rolling forces $P_i$ among the N stands in a given path schedule and that in a re-scheduled path schedule, and FIG. 2B likewise compare distributions of rolling reductions $(H_i-h_i)/H_i$ (see FIG. 7A) before and after the re-scheduling. They cooperatively illustrate how the system SS1 eliminates limit-exceeding states of such rolling conditions.

In FIG. 2A, letting condition-(1) be the rolling force $P_i$, rolling force limits L(2,1) and L(3,1) are exceeded at stands F2 and F3 in the basic path schedule, but rolling forces $P_2$ and $P_3$ at the stands F2 and F3 are lowered in conformity with those limits in a re-scheduled path schedule. At the same time, in FIG. 2B, letting condition-(2) be the rolling reduction, corresponding limit L(1,2) is exceeded at stand F1 in the basic path schedule, but reduction at the stand F1 is reduced in conformity with this limit in the re-scheduled path schedule. A limit check table for FIGS. 2A and 2B may be configured as follows.

| | Stand | | | | | | |
|---|---|---|---|---|---|---|---|
| Condition | No. 1 | No. 2 | No. 3 | No. 4 | No. 5 | No. 6 | No. 7 |
| (1) Rolling force | − | + | + | − | − | − | − |
| (2) Reduction | + | − | − | − | − | − | − |
| . . . | − | − | − | − | − | − | − |
| (M) . . . | − | − | − | − | − | − | − |

Like this, under the basic path schedule, two or more stands Fi* might have failed to meet requirements for one or more rolling conditions-(j*). In the system SS1, however, such failures are effectively eliminated by a re-scheduling process in which, e.g. for the stand F1* to have a conforming rolling reduction, there is calculated a necessary correction amount $\Delta\gamma_i$ of rolling force ratio $\gamma_i$ in accordance with expression (3), as well as necessary force ratio correction amounts $\Delta\gamma_2$ and $\Delta\gamma_3$ calculated in accordance with expression (5) for the stands F2* and F3* to be conforming, whereby target force ratios $\gamma_{ti}$ for the stands Fi* (i=1 to 3) are determined to be based on for calculation of an optimum path schedule.

FIG. 3 shows an essential part of a flow of control associated with a conditionally selective one 100 of various target ($\gamma_{ti^*}$) setting routines in the re-scheduling process of the system SS1.

With respect to the basic path schedule that is given by the set-up calculation FSUC, a judgment is made (at a step 103) by the limit checker 2 for a respective one Fi (i=1 to N) of the N stands (that is identified for a current processing at a step 102), as to whether or not a limit value of a respective one of the M rolling conditions-(j: j=1 to k) (that is identified for the current processing at a step 101) is exceeded in a predicted state.

For a current rolling condition-(j*), the limit checker 2 stores (at a step 104) resultant data for any stand Fi* at which a limit L(i*,j*) is exceeded (step 104) in a current prediction, and after the judgment is made for all the N stands (as confirmed at steps 105 and 106), a current (j*-th) row of a current limit check table is prepared for a current piece of a current decision (by the decision-maker 3*a*) on non-conformity of the mill.

In response to the current piece of decision, a main file of the force ratio correction amount ($\Delta\gamma_i$) calculator 4 determines (at a step 107) a necessary correction amount $\Delta\gamma_i$ of rolling force ratio $\gamma_i$ for each stand Fi* that is non-conforming to a requirement for the current conditions-(j*).

After the foregoing steps 101 to 109 have been repeated for all the M conditions-(j) (as confirmed at steps 108 and 109), a target correction ($\Delta\gamma_i$) setter of the correction amount ($\Delta\gamma_i$) calculator 4 executes (at a step 110) for each stand Fi* either an identification in which a single calculated correction amount $\Delta\gamma_i$ is identified to be a target correction amount ($\Delta\gamma_i$) for the stand Fi*, or a selection in which a maximal one of two or more different correction amounts $\Delta\gamma_i$ (or one of two or more identical correction amounts $\Delta\gamma_i$) is selected as a target correction amount ($\Delta\gamma_i$) for the stand Fi*.

As a result, a single correction amount $\Delta\gamma_i$ is set for each non-conforming Fi*, and data on correction amounts $\Delta\gamma_i$ for respective stands Fi* are processed at the target force ratio ($\gamma_{ti^*}$) setter 5 to provide a target force ratio $\gamma_{ti^*}$ for each stand Fi*, before the re-scheduling to be performed as described for the N stands of the mill.

In the routine 100, the limit check table has a current j-th row prepared for a corresponding rolling condition-(j) checked for non-conformity at one or more stands Fi*, and the force ratio correction amount calculator 4 calculates one or more necessary correction amounts of force ratio for simultaneous elimination of non-conformity at the one or more stands Fi*, before preparation of a subsequent (j+1)-th row of the limit check table.

Figure 4:
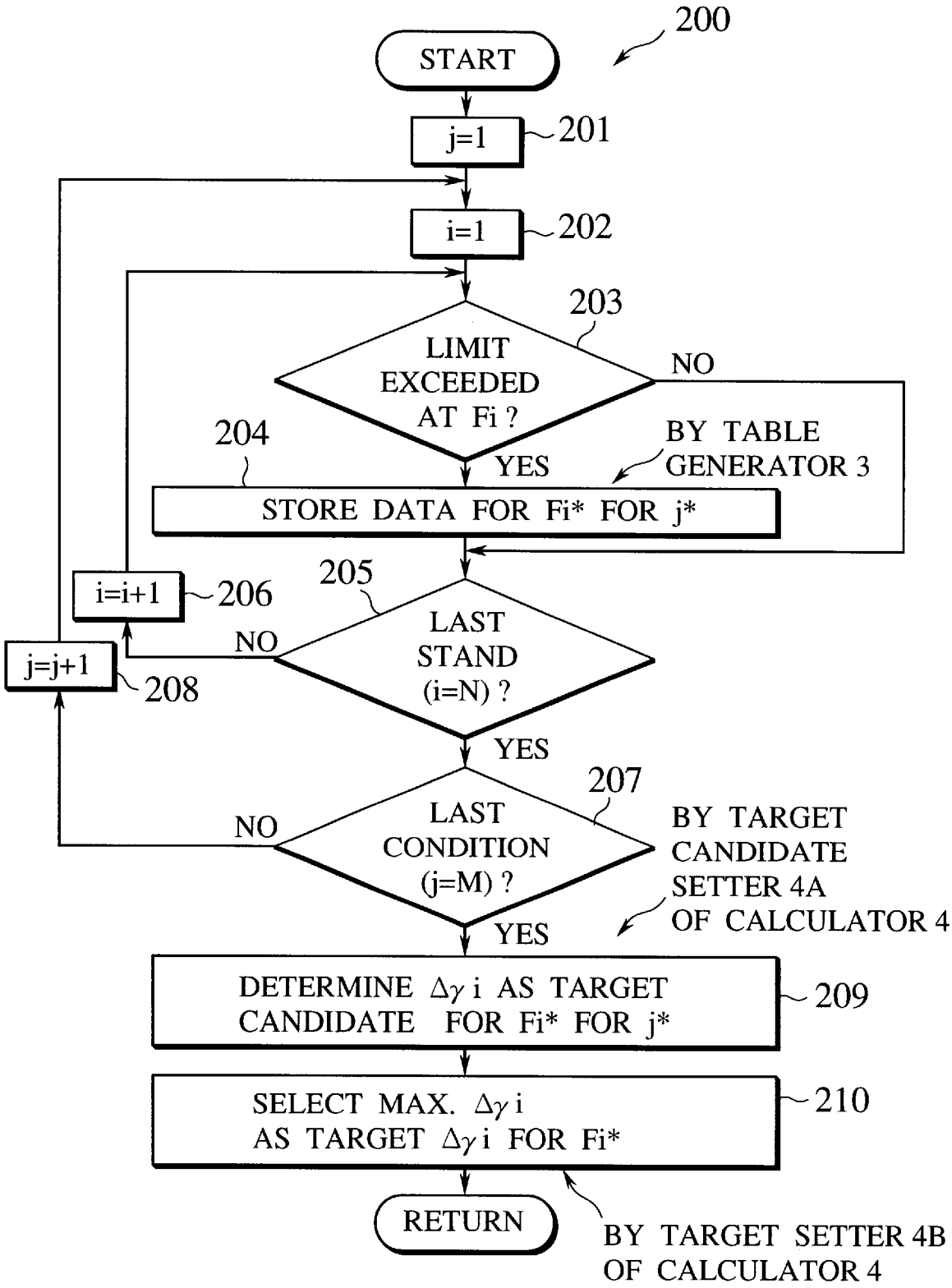
FIG. 4 is a flowchart of control associated with another target setting routine in the re-scheduling process of the system of FIG. 1.

FIG. 4 shows an essential part of a flow of control associated with another conditionally selective one 200 of target ($\gamma_{ti^*}$) setting routines in the re-scheduling process of the system SS1.

This routine 200 has steps 201 to 205 and a combination of steps 207 and 208, which correspond to the steps 101 to 105 and the steps 108 and 109 of the routine 100, respectively. Steps 209 and 210 substantially correspond to the steps 107 and 110, respectively. However, the step 209 follows the step 207. Accordingly, in the routine 200, a total of M rows of a limit check table are all prepared to be provided for a whole condition check of whole stands. Corresponding steps have corresponding functions subject to the determination of force ratio correction amounts ($\Delta\gamma_i$) at the step 209, which will be described below.

It is now assumed that letting a rolling condition-suffix set {j*}={ja, jb, jc (where ja, jb and jc are arbitrary integers≦M)} and a mill stand-suffix set {i* }={iu, iv, iw (where iu, iv and iw are arbitrary integers≦N)}, limits L(iu,ja), L(iv,jb) and L(iw,jc) of rolling conditions-(ja, jb, jc) are exceeded at stands Fiu, Fiv and Fiw, respectively. Note that elements ja, jb, jc of the set {j*} may be different or identical, and elements iu, iv, iw of the set {i*} may also be different or identical.

Assuming correction amounts $\Delta\gamma_{iu}$, $\Delta\gamma_{iv}$, and $\Delta\gamma_{iw}$ of rolling force ratios $\Delta\gamma_{i^*}$ to be necessary at the stands Fi* for required corrections $\Delta E_{ja}$, $\Delta E_{jb}$ and $\Delta E_{jc}$ of errors Eja, Ejb and Ejc for the conditions-(j*), respectively, a target candidate setter 4A of the force ratio correction amount calculator 4 has defined therein a relationship, such that:

$$\begin{bmatrix} \Delta E_{ja} \\ \Delta E_{jb} \\ \Delta E_{jc} \end{bmatrix} = \begin{bmatrix} \partial E_{ja}/\partial\gamma_{iu} & \partial E_{ja}/\partial\gamma_{iv} & \partial E_{ja}/\partial\gamma_{iw} \\ \partial E_{jb}/\partial\gamma_{iu} & \partial E_{jb}/\partial\gamma_{iv} & \partial E_{jb}/\partial\gamma_{iw} \\ \partial E_{jc}/\partial\gamma_{iu} & \partial E_{jc}/\partial\gamma_{iv} & \partial E_{jc}/\partial\gamma_{iw} \end{bmatrix} \begin{bmatrix} \Delta\gamma_{iu} \\ \Delta\gamma_{iv} \\ \Delta\gamma_{iw} \end{bmatrix}. \tag{19}$$

This relationship (19) is purposive as a set of soluble simultaneous equations when a determinant of the matrix of numerical influence factors ($\partial E_{j^*}/\partial\gamma_{i^*}$) is inequal to a zero, such that:

$$det \begin{bmatrix} \partial E_{ja}/\partial\gamma_{iu} & \partial E_{ja}/\partial\gamma_{iv} & \partial E_{ja}/\partial\gamma_{iw} \\ \partial E_{jb}/\partial\gamma_{iu} & \partial E_{jb}/\partial\gamma_{iv} & \partial E_{jb}/\partial\gamma_{iw} \\ \partial E_{jc}/\partial\gamma_{iu} & \partial E_{jc}/\partial\gamma_{iv} & \partial E_{jc}/\partial\gamma_{iw} \end{bmatrix} \neq 0. \tag{20}$$

After checking this condition (20), the candidate setter 4A solves the simultaneous equations, such that:

$$\begin{bmatrix} \Delta\gamma_{iu} \\ \Delta\gamma_{iv} \\ \Delta\gamma_{iw} \end{bmatrix} = \begin{bmatrix} \partial E_{ja}/\partial\gamma_{iu} & \partial E_{ja}/\partial\gamma_{iv} & \partial E_{ja}/\partial\gamma_{iw} \\ \partial E_{jb}/\partial\gamma_{iu} & \partial E_{jb}/\partial\gamma_{iv} & \partial E_{jb}/\partial\gamma_{iw} \\ \partial E_{jc}/\partial\gamma_{iu} & \partial E_{jc}/\partial\gamma_{iv} & \partial E_{jc}/\partial\gamma_{iw} \end{bmatrix}^{-1} \begin{bmatrix} \Delta E_{ja} \\ \Delta E_{jb} \\ \Delta E_{jc} \end{bmatrix}. \tag{21}$$

Resultant three solutions are candidates for correction amounts $\Delta\gamma_{iu}$, $\Delta\gamma_{iv}$ and $\Delta\gamma_{iw}$ of rolling force ratios $\Delta\gamma_{i^*}$ at the stands Fi*. Therefore, if two or more of the three suffixes iu, iv and iw are identical to each other, a maximal one $\Delta\gamma_i^{max}$ of corresponding candidates is selected at the step 210 by a target setter 4B of the correction amount calculator 4, to be set as a single target of force ratio correction ($\Delta\gamma_i$) for the stand Fi*. If the three suffixes iu, iv and iw are different each other, corresponding three targets are each respectively selected at the step 210 by the target setter 4B, to be set as a single target ($\Delta\gamma_i$) for a corresponding stand Fi*. Data on one or more force ratio correction targets ($\Delta\gamma_i$) thus set are processed at the force ratio target ($\gamma_{ti^*}$) setter 5.

It will be seen that the number of elements of the condition-suffix set {j*} may well be increased up to Q (see page 13) or M (see page 9), as necessary, and that of the stand-suffix set {i*} may be increased up to N, as well, as there exists a corresponding limit set {L(i,j)} to which sufficient sample data {D(i,j)} (see page 10) as well as data on error check results {+,−} (see page 11) are component-wise available for definition of a corresponding relationship such as (19).

By the routine 200 in which conditions are treated more uniformly than in the routine 100 for determination of necessary rolling force correction amounts $\Delta\gamma_i$, the system SS1 is allowed for a better determination of an optimum path schedule, permitting a respective limit-exceeding rolling condition or offending stand to be restored by a minimized force ratio correction, as required for conformity at each stand Fi*. For the remaining stands Fi, corresponding force ratios under the basic path schedule are to be reserved as targets therefor.

Incidentally, in e.g. a hot strip mill which continuously hot rolls a coil as a strip, it is important to determine an optimum path schedule allowing a stable feed at a head of the coil, so as to achieve high precision in thickness at the coil head. On the other hand, as the coil head is transported from the mill and taken up by a down coiler, in order to accommodate the drop in bar temperature with passage of time (which is called "thermal rundown"), generally the pivot stand has an accelerated speed. In this respect, for a coil part called "middle" for which the acceleration has been completed, although it is unnecessary to reset a rolling reduction at each associated stand, it is preferable to check for errors in regard of limiting conditions on the speed.

With regard to the middle of coil, the limiting conditions are the rolling torque, the motor power, and the rolling speed. As the coil head has already been bitten by the rolling mill, there is no need to check the bite angle. For the exit thickness of coil, a roll gap is set as required from other functions such as automatic thickness control, without calling for precise determination of a resultant thickness. It however is yet necessary to check the middle relative to requirements for the speed related conditions.

Figure 5:
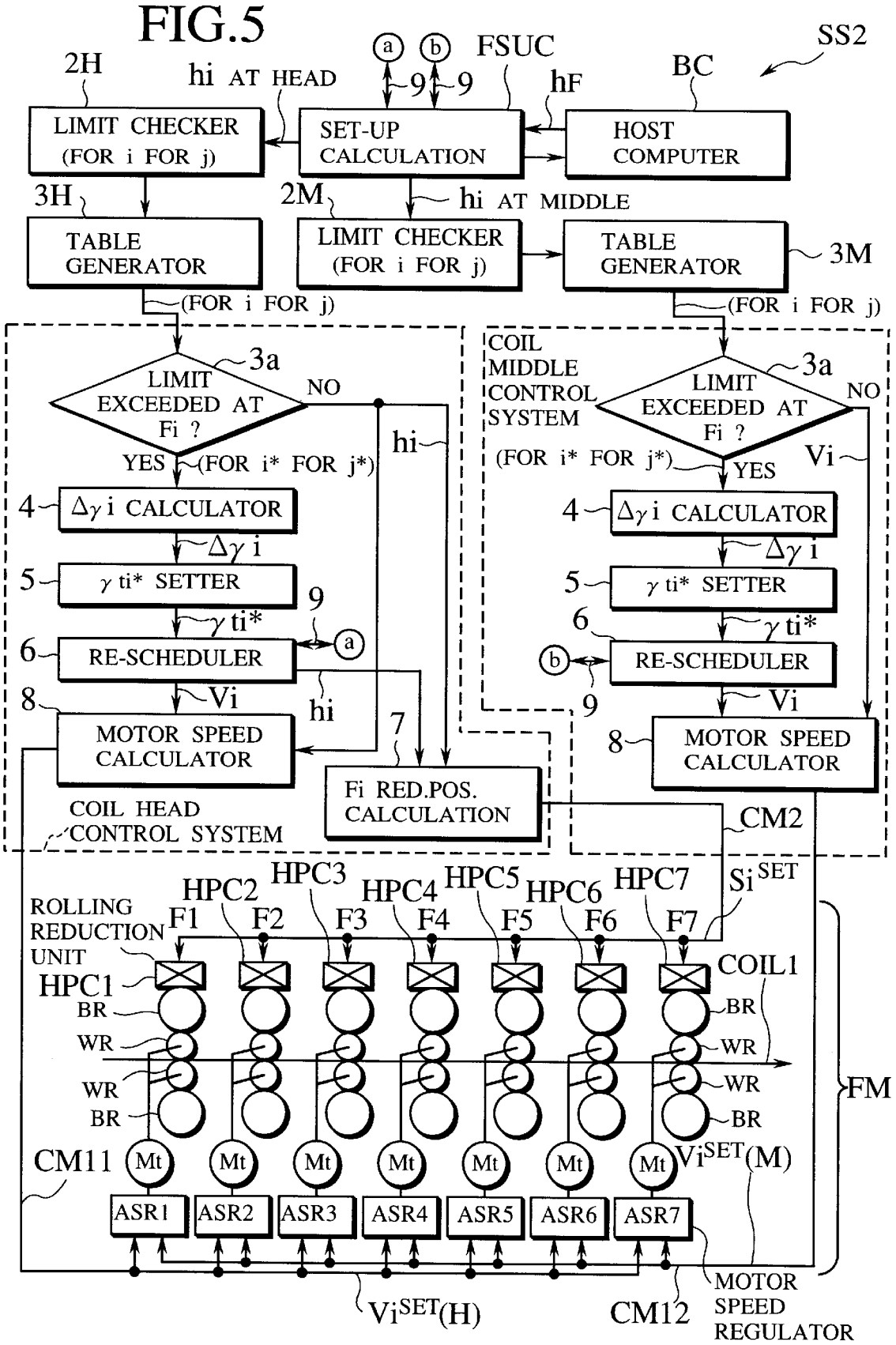
FIG. 5 is a block diagram showing another embodiment of the invention.

FIG. 5 shows an optimum path schedule determining system SS2 as a path scheduling system for a rolling mill FM according to a second embodiment of the invention.

In this system SS2, a current path schedule comprises: a current head path schedule that covers schedule items for a head of a coil 1, including as re-schedulable items therefor an exit thickness $h_i$ and a roll peripheral speed $V_i$ at a respective mill stand Fi; and a current middle path schedule that covers schedule items delayed or phase-shifted on temporal axis for a middle of the coil 1, including as a re-schedulable item therefor a phase-shifted roll peripheral speed $V_i$ at the respective mill stand Fi.

In the system SS2 also, the current path schedule is first prepared in a finisher set-up calculation FSUC based on data (including full specifications such as for a final thickness hF) from a host computer BC as well as previous data from interfaces 9 (via nodes 'a' and 'b'), and is given as a basic path schedule including a basic head path schedule and a basic middle path schedule.

The basic head path schedule is re-scheduled like in the system SS1, so that the re-schedulable items $h_i$ and $V_i$ are re-scheduled as necessary via a head limit checker 2H (common to the limit checker 2 of FIG. 1), a head limit check table generator 3H (common to the table generator 3 of FIG. 1), and a coil head control system including system elements 3*a* and 4–9 (common to those of FIG. 1). Resultant head-oriented reduction position setting values $S_i^{SET}$ and motor speed setting values $V_i^{SET}$(H) are sent (from 7 and 8) via command lines CM2 and CM11 to rolling reduction units $HPC_i$ and automatic motor speed regulators $ASR_i$, respectively.

The basic middle path schedule is re-scheduled in a similar program (to the system SS1), in which a coil middle thickness $h_i$ is always deemed to be conforming, so that the re-schedulable item $V_i$ is re-scheduled as necessary via a middle limit checker 2M (common to the limit checker 2 of FIG. 1), a middle limit check table generator 3M (common to the table generator 3 of FIG. 1), and a coil middle control system including system elements 3*a*, 4–6 and 8–9 (common to those of FIG. 1). Resultant middle-oriented motor speed setting values $V_i^{SET}$(M) are sent (from 8) via a command line CM12 to the motor speed regulators $ASR_i$.

That is, with respect to the middle of the coil 1, a limit checker 2M for each stand (for the middle of the coil) performs a check of the above-noted conditions. Based on the resulting output, a limit check table of the same contents as the table generated for the head of the coil is generated by the limit check table generator 3M. Based on the output of this limit check table, if there is a stand at which a limit is exceeded, the force ratio correction amount calculator 4 calculates the force ratio correction amount $\Delta\gamma_i$ to make the correction of this condition, as necessary. Then, based on the output of the force ratio correction amount $\Delta\gamma_i$, the force ratio setter 5 calculates the corrected force ratio $\gamma_{i*}$ with respect to the middle part of the coil. Based on this corrected force ratio $\gamma_{i*}$, the re-scheduler 6 calculates the correction speed $V_{i*}$ for each stand in the middle of the coil. Based on that output, the speed calculator 8 for each stand calculates the speed setting value $V_i^{SET}$ for each stand with respect to the middle part of the coil, and outputs these values to the automatic speed regulators ASR1 to ASR7 for each stand. By doing this, in rolling a single coil, in addition to determining the optimum path schedule for the head of the coil, taking into consideration the speed, it is also possible to use a similar method to perform limit checking with respect to the middle part of the coil, thereby enabling stable rolling of the overall coil.

It will be understood that elements in the foregoing embodiments may well be implemented as hardware or software. The hardware implementation may include a stand limit checker 2, a limit check table generator 3, a force ratio correction amount calculator 4, a force ratio setter 5, and a re-scheduler 6. It is alternately possible to implement the described functions by program files in the set-up calculation FSUC.

Additionally, while the foregoing description has been for the case in which it is possible to express the rolling conditions with appropriate equations, it should be noted that there are cases in which the conditions do not permit such expression by equations, in which case several successive iterations of the method of determining the optimum path schedule of the present invention are performed so as to change the force ratio correction amounts a direction that eliminates the condition in which limits of conditions difficult to express by equations is removed, thereby resulting in an optimum path schedule. Additionally, while the foregoing embodiments of the present invention are applied to a tandem rolling mill having a plurality of stands, it is possible to alternately apply the present invention to a rolling mill having a single stand, through which the material to be rolled is repeated passed, in which case, in contrast to the case of a continuous rolling mill, while there is no need to have the path schedule maintain constant mass flow, the present invention still features an advantage in terms of ensuring the mechanical quality of the rolled material in the longitudinal direction, and is highly effective when applied as a means of optimizing the repeated path schedule in this case.

As will be seen from the foregoing embodiments, the present invention has the following additional aspects among other aspects thereof than those described in the summary of the invention:

A first aspect is a method for determining an optimum path schedule for a rolling mill having a plurality of stands at which a coil is rolled, whereby, with respect to a basic path schedule given by prescribed rolling conditions, a determination is made for each stand as to whether or not limit values of the plurality of limit values are being exceeded and, in the case in which at least one limit value is being exceeded, the amount of force ratio correction $\Delta\gamma_i$ for the rolling force ratio $\gamma_i$ for the offending stand (ratio obtained by normalizing the rolling force of each stand by dividing it by the maximum rolling force of the stands) in order that no limit value is exceeded under all rolling conditions at which the limit was exceeded is calculated, the maximum value of the force ratio correction amount at each of the stands at which a limit value is exceeded being taken as the force ratio correction amount for the stand, a value obtained by adding this to the rolling force ratio $\gamma_i^*$ of each stand in the basic schedule being taken as the corrected target rolling force ratio $\gamma_i^*$ of each stand in the rolling mill, the solution for the variables exit thickness $h_i$ and correction speed $V_i$ that result in satisfaction of conditions at all stands being solved for, this representing a simultaneous determination of the corrected exit thickness $h_i^*$ and the stand speed $V_i^*$ for each stand, these being stored as the condition required for the offending stands to not exceed the limit values, the force distribution ratio of the basic path schedule being stored for the other stands, and a path schedule being established that enables strict maintenance of constant mass flow through all the stands. According to this aspect, if a plurality of limit values for rolling conditions are exceeded at one and the same stand, and differing force ratio correction amounts $\Delta\gamma_i$ are determined for each of the limit values, by using the maximum value thereof as the force ratio correction amount $\Delta\gamma_i$, the condition in which a plurality limit values with regard to rolling conditions is exceeded is removed. Next, by simultaneously determining the corrected exit thickness $h_i^*$ and corrected speed $V_i^S$, based on this force ratio correction amount $\Delta\gamma_i$, so that the corrected target rolling force $\gamma_i^*$ is satisfied at all of the stands, it is possible to establish an optimum path schedule that strictly satisfies the condition of constant mass flow while holding parameters at the offending stand within each of the limits, with the force distribution ratio of the basic path schedule being used for the remaining stands.

A second aspect is a system for determining an optimum path schedule for a rolling mill having a plurality of stands, this system having: a reduction unit at each stand for adjusting the opening of the roll thereof; a main motor at each stand for rotationally driving the roll thereof; an automatic speed regulator to control the main motors to a prescribed rotational speed; a host computer for giving the target thickness at the exit side of the rolling mill; a setup calculator for receiving the target exit thickness from the host computer and determining a basic path schedule based on prescribed rolling conditions; stand limit checker at each stand for checking whether or not a plurality of limit values of rolling conditions in the basic path schedule are being exceeded; a limit check table generator for receiving the results of the checks by each stand limiting checker, and generating a go/no-go table with respect to limit value compliance for each limit value at each stand; a force ratio correction amount calculator which, when there are a plurality of stands at which at least one limit value has been exceeded, calculates and outputs for all conditions for which a limit value was exceeded, the rolling force correction amount $\Delta\gamma_i$ of the a rolling force ratio $\gamma_i$ (ratio obtained by normalizing the rolling force of each stand by dividing it by the maximum rolling force of the stands); a force ratio setter for outputting values that are the rolling force ratio values $\gamma_i$ for each stand in the basic path schedule to which is added the maximum value of the force ratio correction amount as a correction of the force ratio for that stand, this being output as the corrected target rolling force ratio $\gamma_i^*$ for that stand of the rolling mill, in a coil re-scheduler for determining the solutions for the exit thickness $h_i$ for each stand and the speed $V_i$ variables for each stand so as to achieve the corrected target rolling force $\gamma_i^*$ at all the stands, this being the simultaneous determination of the corrected exit thickness $h_i^*$ and corrected speed $V_i^*$ for each stand; a rolling reduction position calculator for receiving the corrected exit thickness at each stand, calculating the rolling reduction position $S_i^{SET}$ at each stand, and outputting this to each of the reduction units; and a stand speed calculator for receiving the corrected speed $V_i^*$ of each stand, calculating the speed setting value $V_i^{SET}$ of each stand, and outputting this to the automatic speed regulators. The basic operation in this aspect is to establish an optimum path schedule whereby the plurality of stands for which a limit value was exceeded are kept all within the limit values, and the basic path schedule is stored for the remaining stands, while maintaining strictly constant mass flow. According to this aspect, a corrected target rolling force ratio $\gamma_i^*$ is determined by the force ratio setter based on the force ratio correction amount $\Delta\gamma_i$, and the corrected exit thickness $h_i^*$ and corrected stand speed $V_i^*$ for each stand that results in satisfying the corrected target rolling force ratio $\gamma_i^*$ at each stand are determined simultaneously. By doing this, it is possible to establish an optimum path schedule which maintains strictly constant mass flow, while observing all limit values at the offending stands and storing the force distribution ratio for the basic path schedule for the remaining stands, the path schedule determined in this manner controlling the rolling reductions and the peripheral speeds.

A third aspect is a method of determining an optimum path schedule for a rolling mill according to the present invention similar to the first aspect, wherein the force ratio correction amount $\Delta\gamma i$ that is required bring all stands to within all limit values is calculated by uniformly calculating the force ratio correction amount $\Delta\gamma_i$ of the rolling force ratio $\gamma_i$ of each stand without assigning any priority sequence thereto. According to this aspect, it is possible to determine the minimum required force ratio correction amount $\Delta\gamma_i$ to remove the condition at which a stand exceeds a limit value of a rolling condition, the rolling ratios $\gamma_i$ of the basic path schedule being stored as is for the remaining stands, thereby achieving an optimum path schedule.

A fourth aspect is a system for determining an optimum path schedule for a rolling mill, this being a variation on the second aspect, wherein the force ratio correction amount calculator uniformly calculates the rolling force ratio $\gamma_i$ and the force ratio correction amount $\Delta\gamma_i$ for all stands and rolling conditions, without assigning priority thereto, thereby calculating and outputting the force ratio correction amounts $\Delta\gamma_i$ required to bring each stand within limit values. According to this aspect, the minimum required force ratio correction amounts required to remove the condition in which limit values are exceeded are calculated for offending stands by the force ratio correction amount calculator.

A fifth aspect is a variation on the optimum path schedule determining system of the second aspect, wherein the optimum path schedule is determined for the leading end of the product coil, the rolling reduction position setting value $S_i^{SET}$ for each stand determined based on that optimum path schedule being output to the reduction units of each of the stands, the speed setting values $V_i^{SET}$ obtained based on the optimum path schedule being output to the automatic speed regulator of each stand. A corrected speed setting value $V_i^{SET}$ (Mt) obtained by the same type of procedure as used for the leading end, for a plurality of rolling conditions of the rolling conditions for the leading end at the center part of the coil in the longitudinal direction are output to the automatic speed regulators of each stand, so as to set the optimum rolling conditions with respect to the center part in the longitudinal direction as well. According to this aspect, when rolling a coil product, in addition to the optimum path schedule for the leading end being determined with consideration given to speed, the speed setting values $V_i^{SET}$ with respect to the center part in the longitudinal direction for each stand, corrected by the same type of procedure as for the leading end, are determined, these being used to control the peripheral speed of the rolls, enabling the achievement of stable rolling of the coil product over its entire length.

A sixth aspect is a variation of the first aspect, which is a method for determining an optimum path schedule for a rolling mill, wherein it is either difficult to express the plurality of rolling conditions using equations or, even if it is possible to express the rolling conditions using equations, their reliability is poor, in which case the judgment with regard to whether or not limit values are being exceeded is made not numerically but rather by a theoretical evaluation. If the judgment is made that a limit is being exceeded and that this condition must be corrected, the force ratio correction amount $\Delta\gamma_i$ of the stand is successively changed in the direction that removes the condition of exceeding the limit value of the rolling condition, and in doing so the required force ratio correction amount $\Delta\gamma_i$ is determined, this being used as the basis for the setting of the corrected target force ratio $\gamma_i^*$ of each stand. This aspect handles the cases in which it is difficult to express the rolling conditions by an equation, in which case the force ratio correction amount $\Delta\gamma_i$ is successively changed in the direction that removes the condition of exceeding the limit value of the rolling condition, so as to determine the required force ratio correction amount $\Delta\gamma_i$, this being used to establish the optimum path schedule.

A seventh aspect is a method for determining an optimum path schedule for a rolling mill having a single stand through which a coil is repeatedly passed so as to thin it to a prescribed thickness, whereby with respect to a basic path schedule given by prescribed rolling conditions, a judgment is made with regard to all the repeated paths as to whether or not a rolling condition limit value is being exceeded. If there are a plurality of paths in which at least one limit value is being exceeded, the force ratio correction amount $\Delta\gamma_i$ for the required rolling force ratio $\gamma_i$ (ratio obtained by normalizing the rolling force of each path by dividing it by the maximum rolling force of the paths) to bring the value for this path under the limit value is calculated, the maximum value of the force ratio correction amount at each of the paths at which a limit value is exceeded being taken as the force ratio correction amount for a path, a value obtaining by adding this to the rolling force ratio $\gamma_i^*$ of each path in the basic schedule being taken as the corrected target rolling force ratio $\gamma_i^*$ of each path in the rolling mill, the solution for the variables exit thickness $h_i$ and correction speed $V_i$ that result in satisfaction of conditions at all paths being solved for, this representing a simultaneous determination of the corrected exit thickness $h_i^*$ and the speed $V_i^*$ for each path, these being stored as the condition required for the offending paths to not exceed the limit values, the force distribution ratio of the basic path schedule being stored for the other paths, so as to determine the optimum path schedule for the case of a single-stand rolling mill. According to this aspect, as applied to a rolling mill having a single stand through which the coil is repeated passed, it is possible to determine the same type of optimum path schedule as for the case in which the present invention is applied to a tandem rolling mill having a plurality of stands.

An eighth aspect is a variation of the optimum path schedule determining system according to the second aspect, wherein the limit checkers of each stand, the limit check table generator, the force ratio setter, and the coil re-scheduler are replaced by software in the setup calculator, thereby implementing the functions of the limit checkers of each stand, the limit check table generator, the force ratio setter, and the coil re-scheduler with software. This variation of the second aspect features a simplified hardware configuration, while achieving the same effect as the second aspect.

The contents of Japanese Patent Application No. 10-345963 from which the priority of the present application is claimed are incorporated herein by reference.

While preferred embodiments of the present invention have been described using specific terms, such description is for illustrative purposes, and it is to be understood that changes and variations may be made without departing from the spirit or scope of the following claims.

What is claimed is:

1. A path scheduling method for a tandem rolling mill having a plurality of mill stands to be controlled in conformity with a plurality of given conditions and a plurality of given constraints thereto to execute a given path schedule for a coil to be rolled by rolls of the plurality of mill stands to scheduled thicknesses at exit sides of the plurality of mill stands, with scheduled peripheral speeds of the rolls, the path scheduling method comprising the steps of:

checking the plurality of mill stands each respectively for non-conformity with any of the plurality of given constraints;

calculating correction amounts of normalized values of rolling forces of non-conforming mill stands, as necessary to meet any of the plurality of given constraints;

correcting the normalized values by a maximal one of the correction amounts to provide corrected values as targets to be achieved at the non-confirming mill stands; and re-scheduling the given path schedule to achieve the targets by determining a plurality of re-scheduled thicknesses of the coil and a plurality of re-scheduled peripheral speeds of the rolls, both independently defining a mass flow of the coil to be constant at the plurality of mill stands.

2. A path scheduling method according to claim 1, wherein the re-scheduling step includes solving a set of simultaneous equations for the plurality of re-scheduled thicknesses of the coil and the plurality of re-scheduled peripheral speeds of the rolls in a relationship covering the mass flow of the coil to be constant.

3. A path scheduling method according to claim 1, wherein the calculating step includes:

calculating as a first candidate a correction amount for a first condition of the plurality of given conditions for an arbitrary mill stand of the non-conforming mill stands, before calculating as a second candidate a correction amount for a second condition of the plurality of given conditions for the arbitrary mill stand; and selecting one of the first and second candidates as a correction amount of a normalized value of a rolling force of the arbitrary mill stand.

4. A path scheduling method according to claim 1, wherein the calculating step includes:

calculating candidate corrections amounts for the plurality of given conditions for an arbitrary mill stand of the non-conforming mill stands; and selecting one of the candidate correction amounts as a correction amount of a normalized value of a rolling force of the arbitrary mill stand.

5. A path scheduling method according to claim 1, wherein:

the basic path schedule comprises a first path schedule covering first schedule items for a head of the coil, and a second path schedule covering second schedule items for a middle of the coil, the second schedule items including a scheduled thickness for the middle of the coil; and the checking step includes unconditionally assuming the scheduled thickness to be conforming.

6. A path scheduling method according to claim 1, wherein the re-scheduling step includes having the plurality re-scheduled exit thicknesses and the plurality of re-scheduled peripheral speeds stepwise approximated for optimization.

7. A path scheduling method according to claim 1, wherein the coil is reciprocally rolled.

8. A path scheduling method according to claim 1, wherein the plurality of given constraints include respective limits of a bite angle and a neutral point among the plurality of given conditions.

9. A path scheduling system for a tandem rolling mill having a plurality of mill stands to be controlled in conformity with a plurality of given conditions and a plurality of given constraints thereto to execute a given path schedule for a coil to be rolled by rolls of the plurality of mill stands to scheduled thicknesses at exit sides of the plurality of mill stands, with scheduled peripheral speeds of the rolls, the path scheduling system comprising:

a checker for checking the plurality of mill stands each respectively for non-conformity with any of the plurality of given constraints;

a calculator for calculating correction amounts of normalized values of rolling forces of non-conforming mill stands, as necessary to meet any of the plurality of given constraints, and correcting the normalized values by a maximal one of the correction amounts to provide corrected values as targets to be achieved at the non-conforming mill stands; and a scheduler for re-scheduling the given path schedule to achieve the targets by determining a plurality of re-scheduled thicknesses of the coil and a plurality of re-scheduled peripheral speeds of the rolls, both independently defining a mass flow of the coil to be constant at the plurality of mill stands.

10. A path scheduling system according to claim 9, wherein the re-scheduler is adapted for solving a set of simultaneous equations for the plurality of re-scheduled thicknesses of the coil and the plurality of re-scheduled peripheral speeds of the rolls in a relationship covering the mass flow of the coil to be constant.

11. A path scheduling system according to claim 9, wherein the calculator is adapted for calculating candidate corrections amounts for the plurality of given conditions for an arbitrary mill stand of the non-conforming mill stands, and selecting one of the candidate correction amounts as a correction amount of a normalized value of a rolling force of the arbitrary mill stand.

12. A path scheduling system according to claim 9, wherein:

the basic path schedule comprises a first path schedule covering first schedule items for a head of the coil, and a second path schedule covering second schedule items for a middle of the coil, the second schedule items including a scheduled thickness for the middle of the coil; and the checker is adapted for unconditionally assuming the scheduled thickness to be conforming.

13. A path scheduling system according to claim 9, wherein the plurality of given constraints include respective limits of a bite angle and a neutral point among the plurality of given conditions.

* * * * *